US007404358B2

(12) United States Patent
Tadros et al.

(10) Patent No.: US 7,404,358 B2
(45) Date of Patent: Jul. 29, 2008

(54) SMOKE PRODUCING MORTAR CARTRIDGE

(75) Inventors: Raef M. Tadros, White Hall, AR (US); Efthimios Papayianis, Dover, NJ (US); Allen A. Dehaghani, White Hall, AR (US); Anthony Martuccio, Stanhope, NJ (US); Raymond S. Trohanowsky, Franklin, NJ (US); James Marlin Pennington, Dumas, AR (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/550,959

(22) Filed: Oct. 19, 2006

(65) Prior Publication Data

US 2007/0175352 A1 Aug. 2, 2007

Related U.S. Application Data

(63) Continuation of application No. 10/820,077, filed on Apr. 7, 2004, now Pat. No. 7,124,690.

(51) Int. Cl.
*F42B 12/46* (2006.01)

(52) U.S. Cl. ..... 102/370; 102/334; 102/368; 102/445

(58) Field of Classification Search ..... 102/334, 102/367–370, 445, 498, 530
See application file for complete search history.

(56) References Cited

U.S. PATENT DOCUMENTS 1,875,985 A * 9/1932 Brandt ..... 102/498
3,612,857 A * 10/1971 Beatty et al. ..... 362/34
3,636,881 A * 1/1972 Godfrey ..... 102/290
4,109,579 A * 8/1978 Carter ..... 102/513
4,186,664 A * 2/1980 Huber et al. ..... 102/334
4,218,978 A * 8/1980 Pasquini ..... 104/12
4,294,172 A * 10/1981 Rauschert et al. ..... 102/473
4,418,624 A * 12/1983 Willi et al. ..... 102/473
4,446,794 A * 5/1984 Simmons ..... 102/513
4,549,487 A * 10/1985 Jensen ..... 102/498
4,898,097 A * 2/1990 Jordan et al. ..... 102/283
4,898,098 A * 2/1990 Frey et al. ..... 102/334
5,251,562 A * 10/1993 Chemiere et al. ..... 102/386
5,448,937 A * 9/1995 Buc et al. ..... 89/1.34
5,522,320 A * 6/1996 Dillehay ..... 102/334
5,661,257 A * 8/1997 Nielson et al. ..... 102/334
5,895,882 A * 4/1999 Woodall, Jr. ..... 102/341
6,176,517 B1 * 1/2001 Hamilton et al. ..... 280/736
6,600,002 B2 * 7/2003 Sanderson et al. ..... 528/78

FOREIGN PATENT DOCUMENTS

DE 3206497 * 11/1982
GB 2056632 * 3/1981

* cited by examiner

*Primary Examiner*—David J Parsley
(74) *Attorney, Agent, or Firm*—Ulysses John Biffoni

(57) ABSTRACT

A mortar cartridge generates effective white or colored smoke obscuration with reduced adverse environmental impact and collateral damage and provides an improved drag assembly that reduces drift during projectile descent and improves targeting.

23 Claims, 6 Drawing Sheets

SMOKE PRODUCING MORTAR CARTRIDGE

This application is a continuation of application Ser. No. 10/820,077 filed Apr. 7, 2004, now U.S. Pat. No. 7,124,690.

GOVERNMENT INTEREST

The invention described herein may be manufactured, licensed, and used by or for the U.S. Government.

TECHNICAL FIELD

The present invention relates generally to smoke producing mortar cartridges and in particular to a mortar cartridge that generates white or colored smoke obscuration with reduced adverse environmental impact and collateral damage, and provides an improved drag assembly that reduces drift during projectile descent and improves targeting.

BACKGROUND

Presently, the only 120 mm cartridge in the U.S. arsenal that produces white smoke is the White Phosphorus (WP) cartridge. While the WP cartridge provides effective smoke obscuration for combat missions it has limited use in training and in peacekeeping missions. White phosphorus has a detrimental environmental impact on wetland areas in addition to other undesirable side effects such as producing secondary fires, and metal fragments. In particular, unburned phosphorous can cause a hazard to friendly forces. Also, the smoke generated from WP cartridges includes acid fumes that are produced from phosphorus oxidation reactions. While a variety of other smoke producing compositions provide effective smoke obscuration they are likewise known to be toxic and irritating. If such cartridges are used for training they require additional safety measures and still have the potential for causing injury to personnel and/or the environment. Thus, there is a need for a reliable, low-toxicity, environmentally friendly smoke producing mortar cartridge.

These and other problems are solved, at least in part, by embodiments of a smoke producing mortar cartridge in accordance with the present invention.

SUMMARY

In general, in one aspect, an embodiment of a smoke producing mortar cartridge in accordance with the present invention includes a shell body, a propellant, an ignition cartridge for igniting the propellant, a fuze, an environmentally friendly smoke producing composition, a metal canister for containing and protecting the smoke producing composition, and a drag assembly comprising one or more streamers to slow the descent of the canister.

In general, in another aspect a smoke producing mortar cartridge in accordance with the present invention includes a smoke producing composition that uses an organic smoke producing agent that includes an aliphatic or aromatic dicarboxylic acid. In general, in another aspect a smoke producing mortar cartridge in accordance with the present invention includes a smoke producing composition that includes Polyvinyl Alcohol as a binder. In general, in another aspect a smoke producing mortar cartridge in accordance with the present invention includes a smoke producing composition that includes polymerized sucrose as a binder.

In general, in another aspect, a smoke producing mortar cartridge in accordance with the present invention includes a smoke producing composition that uses a Terephthalic acid (TA) based pyrotechnic white smoke producing agent.

In general, in another aspect, a smoke producing mortar cartridge in accordance with the present invention includes a smoke producing composition that includes a mixture of 53 to 57 weight percent Terephthalic acid, 3 to 6 weight percent Magnesium Carbonate, 23 weight percent Potassium Chlorate, 1 to 3 weight percent Stearic Acid, 14 weight percent Sucrose, and 1 weight percent a Polyvinyl Alcohol binder.

In general, in another aspect, a smoke producing mortar cartridge in accordance with the present invention includes a smoke producing composition that includes Terephthalic acid (TA) based pyrotechnic white smoke composition that includes a mixture of 53 to 57 weight percent Terephthalic acid, 3 to 6 weight percent Magnesium Carbonate, 23 weight percent Potassium Chlorate, 1 to 3 weight percent Stearic Acid, and 14 weight percent Sucrose, wherein 12% to 100% of the Sucrose is polymerized to become a binder.

Other aspects, features, and advantages of the present invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications

BRIEF DESCRIPTION OF THE DRAWINGS

A preferred exemplary embodiment of the invention is illustrated in the accompanying drawings in which like reference numerals represent like parts throughout and in which.

DETAILED DESCRIPTION

In the following detailed description, reference is made to the accompanying drawings that form a part hereof, and in which are shown by way of illustration specific embodiments in which the invention, as claimed, may be practiced. This invention may, however, be embodied in many different forms and should not be construed as limited to the embodiments set forth; rather, these embodiments are provided so that his disclosure will be thorough and complete, and will fully convey the scope of the invention to those skilled in the art. For example, embodiments of the present invention have been illustrated using 120 mm cartridges, but the principles and concepts of the present invention would also apply to a variety of other projectiles including 60 mm and 81 mm mortar cartridges.

The smoke from a smoke producing mortar cartridge, such as a 120 mm shell, can be delivered several kilometers away from the gun position. When the cartridge approaches the target areas a fuze assembly (e.g., a time fuze) will ignite to separate the shell body, cause the canister to be expelled from the shell and cause the smoke producing composition held in the canister to ignite. As the smoke producing canister lands a dense cloud of smoke is generated, typically for a duration of 55 to 75 seconds.

Figure 1:
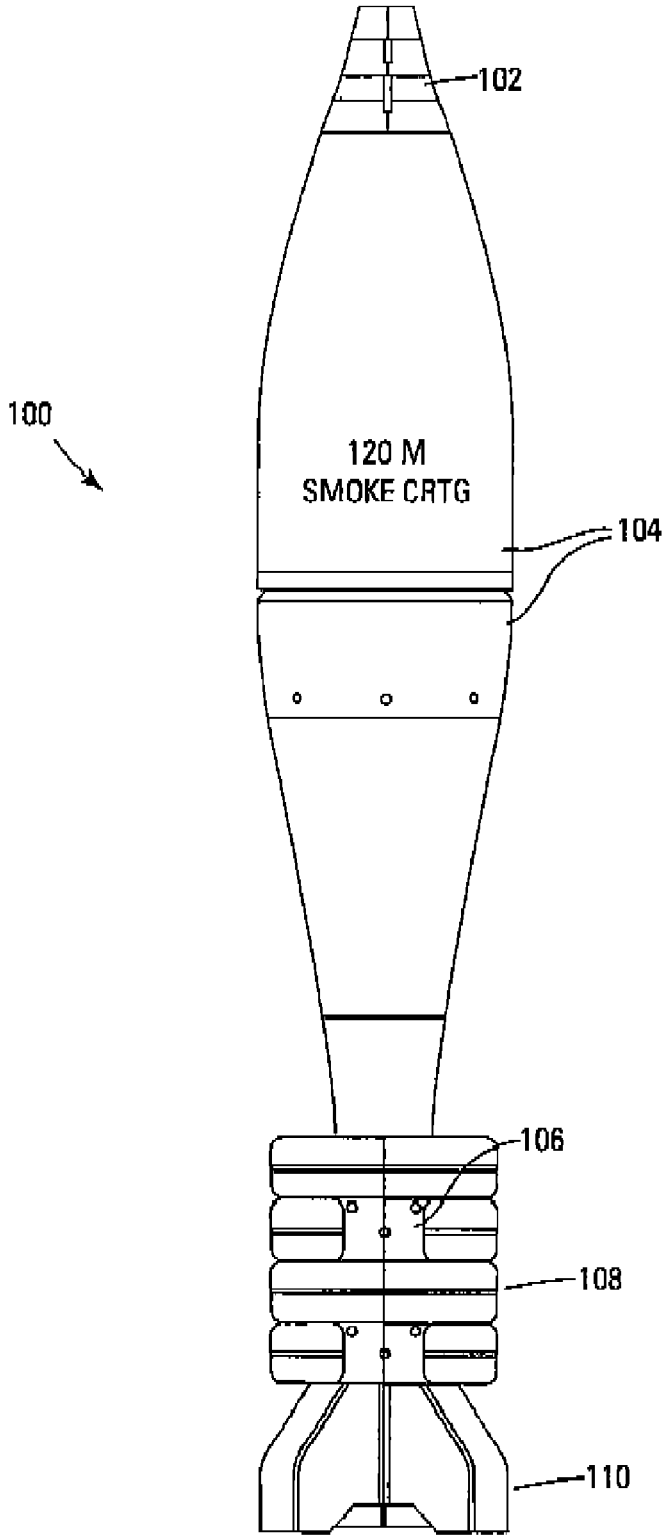
FIG. 1 shows an external side view schematic of a smoke producing cartridge in accordance with an embodiment of the present invention.

FIG. 1 shows an external side view schematic of a preferred embodiment of a 120 mm smoke producing cartridge 100 in accordance with the present invention. Smoke producing cartridge 100 is intended for use in a variety of applications including Military Operations in Urban Terrain and in stability and support operations where an effective smoke signature is required while minimizing noncombatant injuries and collateral damage. Smoke producing cartridge 100 includes a fuze assembly 102 (such as an M766 mechanical time fuze), a two-part shell body 104 for carrying a payload, a propellant ignition system 106, a propellant charge system 108 and a fin assembly 110. From an external viewpoint, the smoke producing cartridge 100 shares many features with conventional 120 mm mortar cartridge designs such as the two-part shell body 104, ignition system 106, the propelling charge system 108 and fin assembly 110, Internally, the smoke producing cartridge 100 differs in many respects from conventional smoke producing rounds. As will be discussed in detail, among the features of one or more embodiments of a smoke producing cartridge according to the present invention are an improved, highly effective and yet environmentally friendly smoke producing composition, a strengthened canister for holding the improved smoke producing composition, a mechanism for igniting the smoke producing composition without exceeding the required firing energy, and a drag force assembly, such as a group of ribbon streamers, that generates a drag force capable of slowing down the smoking, falling canister (2.27 kg) one third from the descent speed from approximately 82 meters/sec to 27 meters/sec and at the same time minimizes drift that might carry the canister away from the target area. As would be familiar to those of skill in the at, the specific height that the canister reaches will depend on the fuze setting, the mortar firing angle, and number of propellant increments used.

Smoke Producing Composition

As noted, conventional smoke producing shells ignite a toxic phosphorous based compound to produce smoke obscuration. In contrast to phosphorous smoke, the smoke developed by cartridge 100 is low in toxicity and non-carcinogenic. The smoke producing composition burns at low temperature and with low energy output and reduces environmental hazards. In general, the smoke producing composition comprises at least one organic smoke-producing agent, e.g., aliphatic or aromatic dicarboxylic acid, at least one oxidizer, at least one fuel, and at least one organic binder. In one exemplary embodiment, the smoke producing agent is a Terephthalic acid (TA) based pyrotechnic smoke composition. TA is known to those of skill in the art as a smoke producing composition and has been used in smoke generating devices such as grenades and is readily available. Other relatively environmentally benign organic smoke producing agents known in the art may also be used.

In a preferred embodiment, a white smoke producing composition according to the present invention include a mixture of 53 to 57 weight percent Terephthalic acid, 3 to 6 weight percent Magnesium Carbonate, 23 weight percent Potassium Chlorate, 1 to 3 weight percent Stearic Acid, 14 weight percent Sucrose, and 1 weight percent of a Polyvinyl Alcohol (PVA) binder. In general, the binder is used to form granulated particles containing all solid mixture components in order to provide a uniformly blended composition and to form consolidated mixture elements of the blended composition. The binder is also effective to reduce the dust concentration during all phases of canister production.

In one alternative embodiment, a white smoke producing composition includes a mixture of between 70 to 100 weight percent Terephthalic acid and 30 to 0 weight percent pentaerythritol (PE).

In another alternative embodiment, the smoke producing composition includes a Terephthalic acid (TA) based Pyrotechnic white smoke composition which comprises a mixture of 53 to 57 weight percent Terephthalic acid, 3 to 6 weight percent Magnesium Carbonate, 23 weight percent Potassium Chlorate, 1 to 3 weight percent Stearic Acid, and 14 weight percent Sucrose, and between 12% to 100% of the Sucrose is polymerized to become the mixture binder and can act as both a binder and a fiel.

In another alternative embodiment the TA and PE combined make up between 53 to 57 weight percent of the smoke producing composition, and the smoke producing composition also includes 3 to 6 weight percent Magnesium Carbonate, 23 weight percent Potassium Chlorate, 1 to 3weight percent Stearic Acid, 14 weight percent Sucrose, and 1 weight percent a Polyvinyl Alcohol binder.

In another alternative embodiment, sucrose may be used as a binder material. Between 12% to 100% of the approximately 14 weight percent sucrose may be polymerized to bind the mixture. In some examples, the sucrose will act as both a binder and a fuel.

In another alternative embodiment, the smoke producing composition may be made from a mixture of 70 to 100 weight percent Terephthalic acid (TA) and 30 to 0 weight percent pentaerythritol (PE), and the TA and PE together make up 53 to 57 weight percent of the smoke producing composition, and the smoke producing composition also includes 3 to 6 weight percent Magnesium Carbonate, 23 weight percent Potassium Chlorate, 1 to 3weight percent Stearic Acid, and 14 weight percent Sucrose, wherein 12% to 100% of the Sucrose is polymerized to become the mixture binder and can act as both a binder and a fuel.

In another alternative embodiment, the smoke producing composition may include a yellow smoke generating composition, which comprises a mixture of 40.2 to 43.2 weight percent Dye, Solvent Yellow 33, 20.5 to 24.5 weight percent Potassium Chlorate, 17.5 to 23.5 weight percent Magnesium Carbonate, 13.8-16.8 weight percent Sucrose, and not more than 2 weight percent a Polyvinyl Alcohol binder.

In another alternative embodiment, the smoke producing composition comprises a yellow smoke generating composition which comprises a mixture of 40.2 to 43.2weight percent Dye, Solvent Yellow 33, 20.5 to 24.5 weight percent Potassium Chlorate, 17.5 to 23.5 weight percent Magnesium Carbonate, and 13.8-16.3 weight percent Sucrose, wherein 12% to 100% of the Sucrose is polymerized to become a binder.

In another alternative embodiment, the smoke producing composition may include a green smoke generating composition which comprises a mixture of 12 to 13 weight percent Dye, Solvent Yellow 33, 28.5 to 30.5 weight percent Dye, Solvent Green 3, 23 to 26 weight percent Potassium Chlorate, 15 to 19 weight percent Magnesium Carbonate, 15.5-17.5 weight percent Sucrose, and not more than 2 weight percent a Polyvinyl Alcohol binder.

In yet another alternative embodiment, the smoke producing composition may include a green smoke generating composition which comprises a mixture of 12 to 13 weight percent Dye, Solvent Yellow 33, 28.5 to 30.5 weight percent Dye, Solvent Green 3, 23 to 26 weight percent Potassium Chlorate, 15 to 19 weight percent Magnesium Carbonate, and 15.5-17.5 weight percent Sucrose, wherein 12% to 100% of the Sucrose is polymerized to become a binder.

In conventional smoke producing artillery shells, the payload of white phosphorus is impregnated in felt wedges contained in a hermetically sealed lightweight steel canister. An MT fuze activates a charge causing ejection of the WP felt-pad wedges which ignite spontaneously upon exposure to the air.

Figure 6:
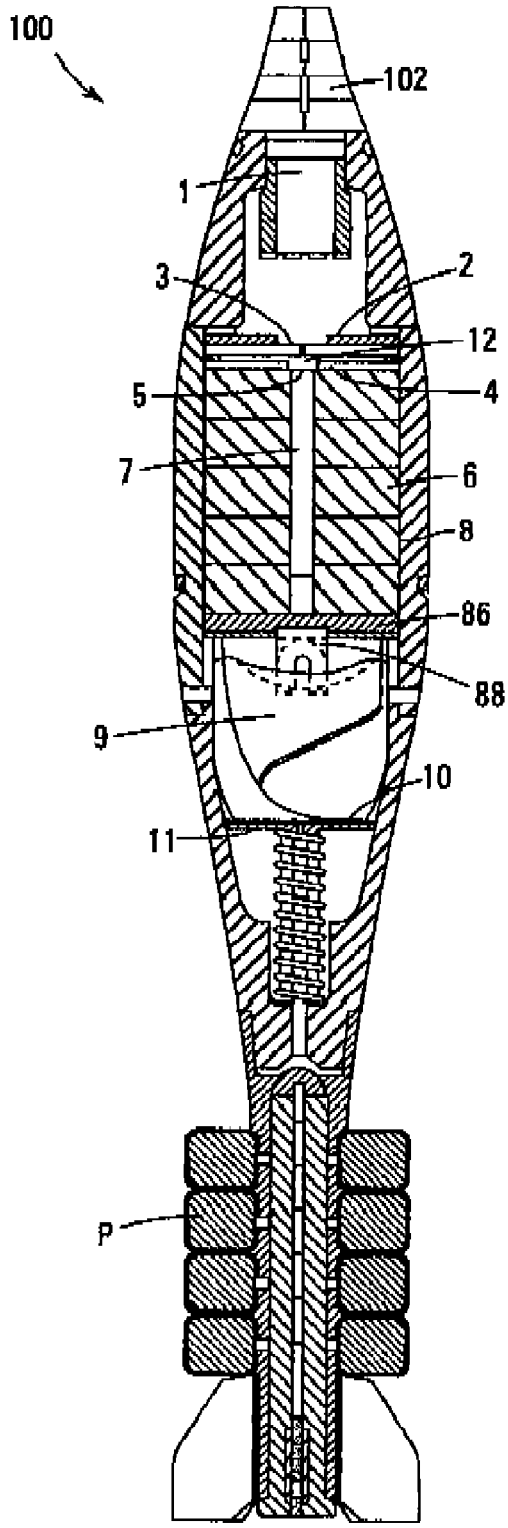
FIG. 6 shows a partial cross sectional side view schematic of a smoke producing cartridge in accordance with an embodiment of the present invention.

In contrast to conventional WP smoke producing artillery shells, smoke producing compositions in embodiments of the present invention do not ignite spontaneously upon being exposed to the air and the ignition process must be carefully controlled. In order to provide for consistent, predictable smoke production and ignition, the smoke producing granulated composition should be consolidated into larger preformed elements that will remain intact until the composition is ignited. In a preferred embodiment, the granulated composition is consolidated into annular (i.e., donut like) or half-annular elements. As shown in FIG. 6, five preformed annular-shaped consolidated smoke producing elements 6, each weighing approximately 200 grams, are stacked one on top of the other in a payload canister 8 within shell 104 of cadge 100. The consolidated smoke producing elements 6 are dimensioned so that the outer diameter will fit snugly within canister 8. The smoke producing elements also preferably include core holes 7 that are concentric with the axis of canister 8 so that a vertical channel is formed therein. The channel formed by core holes 7 allows for expansion during firing and improves ignition reliability.

Firing of a mortar cartridge subjects the payload (i.e., the canister and its contents) to extreme forces. During lunch, the canister may experience a setback force of approximately 10,650 g's. During separation of the two-part shell body, the canister will undergo a lesser but still significant setback force. The canister will also experience a significant force upon returning to the ground. A binder of sufficient strength is needed to prevent the consolidated smoke producing elements 6 from breaking up under such forces. As the same time, the binder must not interfere with ignition of the smoke producing composition. In a preferred embodiment, a Polyvinyl alcohol binder is used. A suitable white smoke producing composition may contain about one percent by weight Polyvinyl alcohol (PVA) binder and still perform in a satisfactory manner. While increasing the PVA binder beyond one percent may somewhat increase the mechanical strength of the white smoke producing composition, the increase in mechanical strength is relatively small. Moreover, as the PVA binder concentration is increased beyond one percent the material balance of the white smoke producing composition is disrupted and the binder may interfere with proper ignition and/or shorten the duration of smoke production.

An Istron machine was used to measure the tensile strength of a 200 gram consolidated white smoke producing composition annular element 6 with one percent by weight PVA binder. The tensile strength was found to be between 40-55 kg. This laboratory test indicated that white smoke producing composition annular elements with a one percent PVA binder concentration would not have sufficient mechanical strength to withstand the launch forces typically encountered by a canister of a conventional 120 mm mortar cartridge.

The laboratory test results were confirmed by test firing conventional 120 mm illumination cartridges with smoke producing composition annular elements loaded within the conventional lightweight steel canister. A series of test firings were conducted with a PVA binder for the smoke producing composition of between 0.75 and one percent. Test rounds were fired ballistically using a variety of typical 120 mm mortar fuze settings, firing angles, and number of propellant increments used. Roughly 50% of the cartridges fired were not able to produce smoke at all. Damage evaluation of those rounds indicated that the conventional 120 mm illumination canisters were bulged and distorted, and the smoke producing composition was frequently pushed out without proper ignition. Additionally, the tests revealed that there was excessive damage to drag assemblies according to the present invention from the conventional 120 mm Illumination canister, which has a rotating swivel for attaching a parachute.

For those test rounds that did ignite, the results were also unsatisfactory. The forces acting on the canister upon firing fractured the smoke producing composition elements, which caused a corresponding increase in the surface areas initially exposed to ignition. This increase in surface area lead to overly fast ignition or detonation and frequently resulted in premature expulsion of the contents of the canister in the air and failure to produce any smoke. Thus, it was determined that conventional 120 mm Illumination canisters simply were not capable of protecting TA based smoke producing compositions and in another aspect of the present invention, an improved canister was devised that solves, at least in part, the problem of adequately protecting the improved smoke producing compositions in a mortar cartridge.

Smoke Producing Canister

Figure 2:
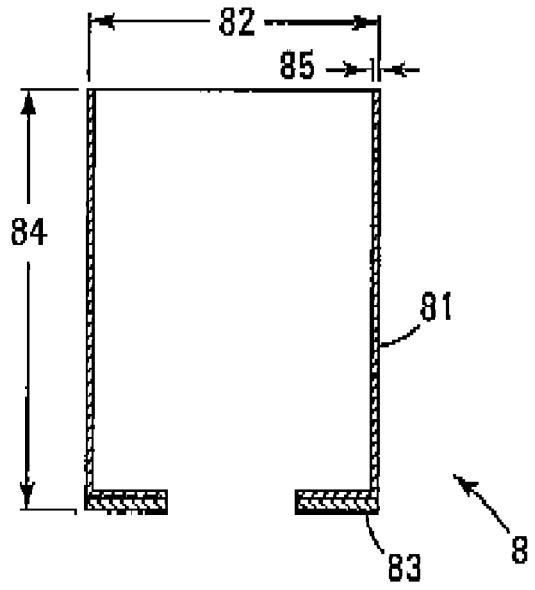
FIG. 2 shows a cross sectional side view of certain components of a canister for holding a smoke producing composition for use in a smoke producing cartridge in accordance with an embodiment of the present invention.
Figure 3:
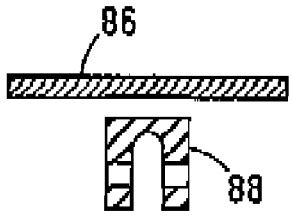
FIG. 3 shows a cross sectional side view of certain other components of a canister for holding a smoke producing composition in a smoke producing cartridge in accordance with an embodiment of the present invention.
Figure 4:
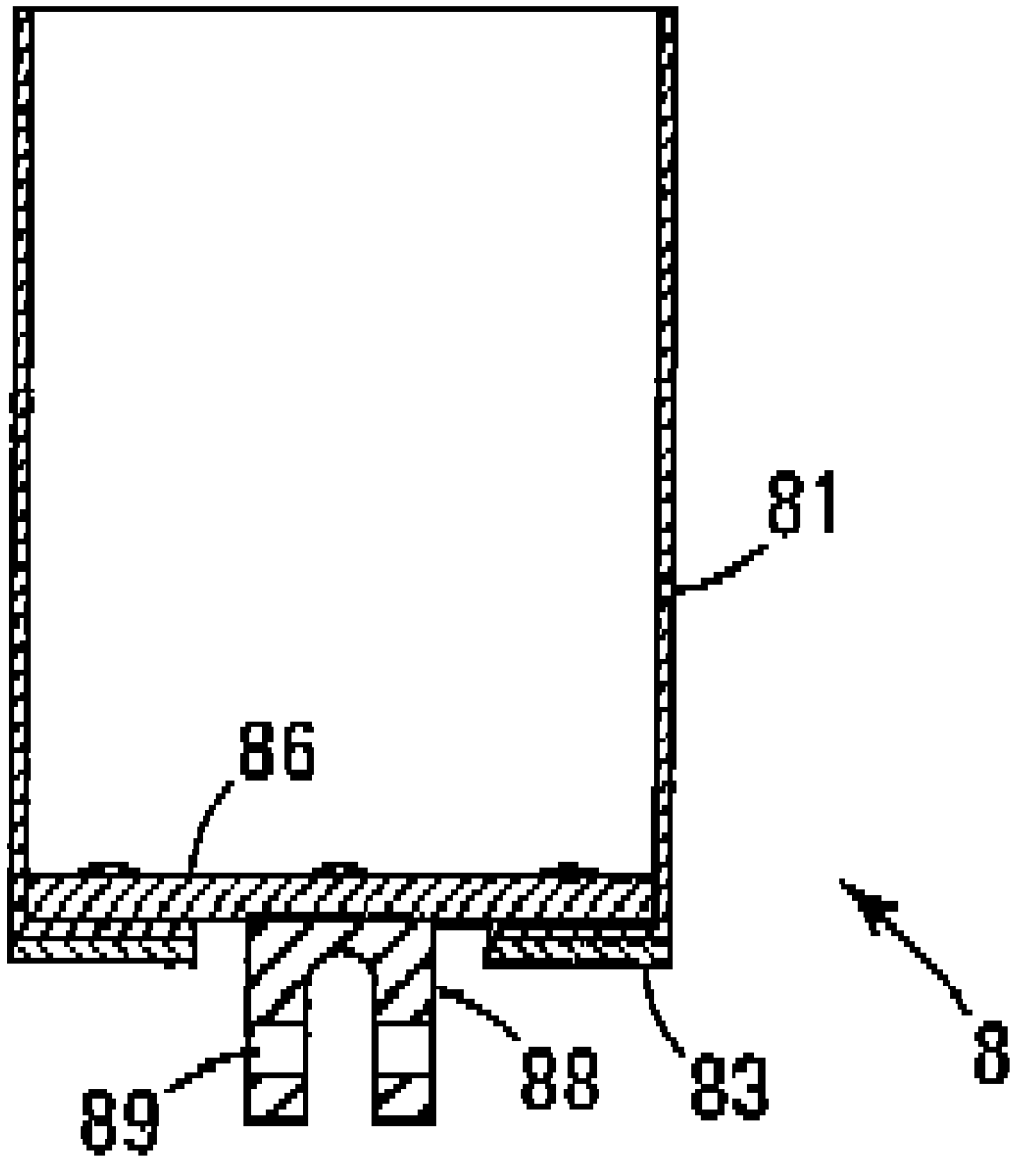
FIG. 4 shows a cross sectional side view of a canister for holding a smoke producing composition in a smoke producing cartridge in accordance with an embodiment of the present invention.

FIG. 2 shows a cross sectional side view of a right circular cylinder steel canister 8 for holding a smoke producing composition in the payload compartment of a mortar shell 104, according to an embodiment of the present invention. Canister 8 has been shock hardened to minimize bulging and distortion and configured to reduce the transfer of forces encountered in firing the projectile that cause damage to the smoke producing composition. Steel Canister a includes a sidewall 81 having an outer diameter 82 of 93.35 mm, a height 84 of 133 mm and a thickness 85 of 1.90 mm. The outer dimensions of canister 8 are sized so that the canister will fit snugly within the payload compartment of shell 104. The bottom 83 of canister 8 is reinforced to provided added protection. As shown in FIGS. 2 and 3, a steel plate 86 is placed inside the empty canister 8 and a steel stud 88 is welded to plate 86. Plate 86 is in turn welded to the bottom of the canister 8 as shown in FIG. 4. The Stud 88 includes a small hole 89 that is used for attaching drag force assembly 9, described below.

Referring to FIG. 6, the contents of canister 8 are loaded as follows. Consolidated smoke producing composition elements 6 are stacked on top of the steel plate 86. A conventional starter patch 5 is placed on top of the stack of consolidated smoke producing composition elements 6. An aluminum plate 4 of approximately the sane outer diameter as consolidated smoke producing composition elements 6 is placed on the top of the starter patch 5. The aluminum plate 4 has a center hole 12 of about the same size as core hole 7, which is used for smoke ventilation. The center hole 12 allows the smoke to release without exceeding the pressure built up inside the canister during firing and maintains enough pressure inside the canister 8 to prevent flaming of the smoke producing composition. The metal caster 8 is crimped around the top edge of sidewall 81 to secure the aluminum plate 4 and cause the starter patch 5 to press snugly against the topmost consolidated element 6, so as to provide for reliable ignition.

As shown in FIG. 6, a second aluminum plate 3 is placed on top of the canister 8. The thickness of aluminum plate 3 limits the movement of the canister 8 during all phases of firing and only allows the canister 8 and the bottom portion of the shell body 104 to move together during two-part shell body separation when the fuze 102 functions to ignite the mixture composition. The aluminum plate 3 pushes against the canister wall and prevents forces from the top of the shell body from pushing directly against the mixture composition.

A felt washer 2 is placed on top of aluminum plate 3 and rests against a ridge at the top of the payload compartment of shell 104. Felt washer 2 has an outer diameter that is about the same as the second aluminum plate 3 and an axial hole of a diameter somewhat greater than axial hole 12. The felt washer 2 takes up any slack in the interior of the payload compartment of shell 104, which may be generated by dimension variations in all assembly components The large axial hole in the felt washer 2 insures propagation of the explosive train from fuze 102 to starter patch 5.

Ballistic tests of cartridges according to an embodiment of the present invention were reliable in ignition and smoke production even when they were fired under extreme conditions (e.g., using four propellant increments, firing at an angle of 80°, and under temperature conditions of 140 F). Cartridges according to embodiments of the present invention are capable of using anywhere from 0 to 4 propellant increments, depending on the firing mission.

Ignition System

A fuze 102 (such as a conventional MT time delay fuze) is positioned at the top of shell 104. Firing flue 102 ignites an ignition charge 1 positioned immediately beneath. The ignition charge 1 includes 15-grams of black powder in a plastic cup. Firing ignition charge 1 opens the two-part shell body 104 by rupturing shear pins at the seam between the two parts and ignites the starter patch 5 which, in turn, ignites consolidated smoke producing composition elements 6.

Aluminum plate 3 includes a relatively small diameter axial hole to limit the ability of the ignition charge 1 to reach the smoke producing composition 6 but provides enough to start the ignition of the starter patch 5. A larger ignition charge is not required and might cause the consolidated smoke producing composition elements 6 to explode. The starter patch 5, which is a Terry clot impregnated with a starter mixture (chemical mixture), is easy to ignite and transfers the ignition to the smoke producing composition due to the physical contact. As the top layer of the consolidated smoke producing composition elements 6 starts to ignite, the mixture will sustain burring and sublimate the smoke generating agent and thus produce dense smoke for a period of between 55-75 seconds. The ignition arrangement discussed above thus provides reliable ignition and insures proper combustion of the smoke producing composition.

Drag Assembly

Conventional illumination cartridges typically use a parachute assembly to slow the canister descent. The parachute assembly however can cause the canister to drift away from the target zone. Embodiments of a drag assembly according to The present invention minimize drift in a controlled descent and at the same time minimize the risk of burial or fragmentation of the canister upon impact with the ground.

Figure 5A:
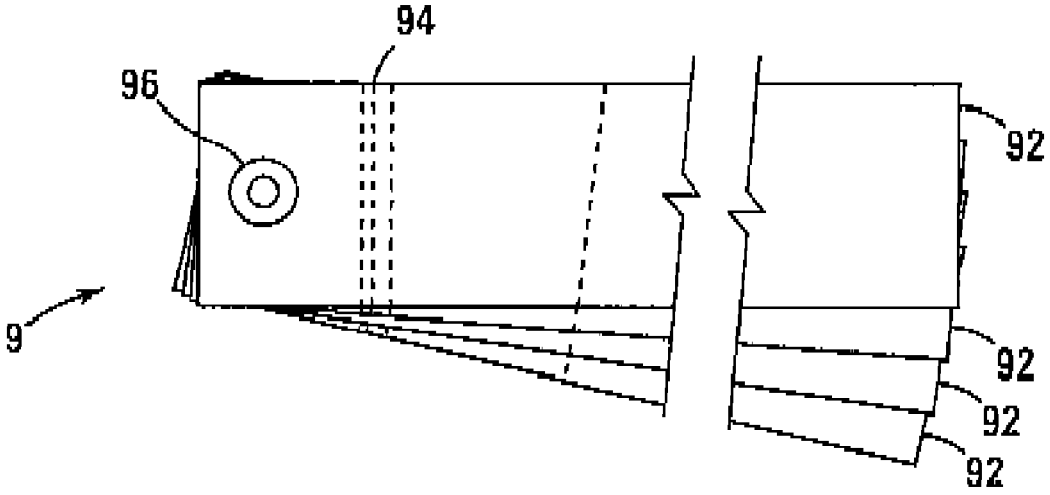
FIG. 5A shows a plan view of an unfolded drag assembly in accordance with an embodiment of the present invention.
Figure 5B:
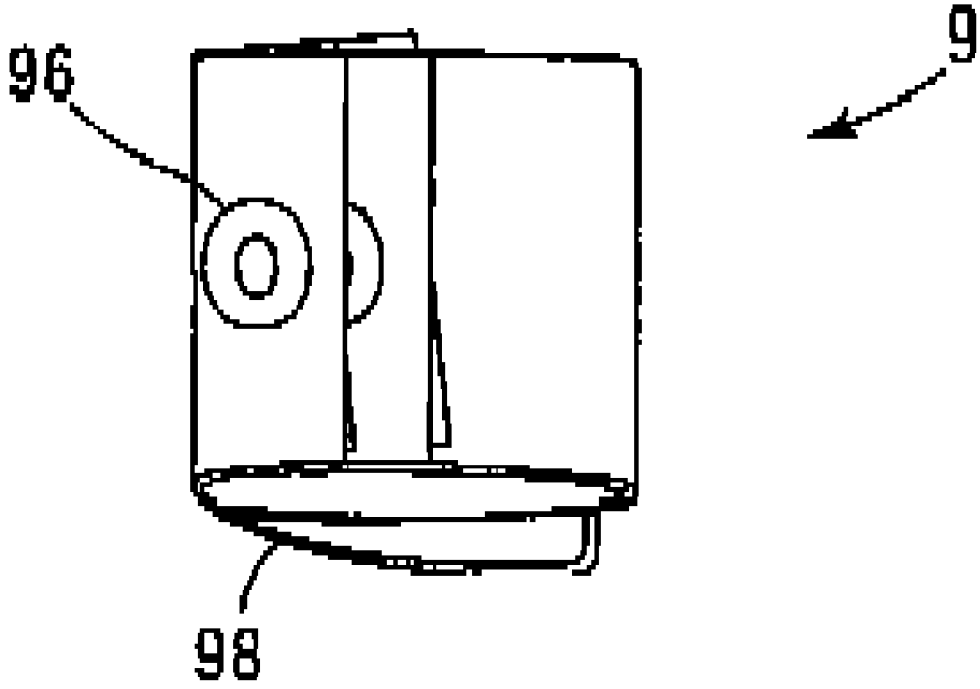
FIG. 5B shows a plan view of a folded drag assembly in accordance with an embodiment of the present invention.

As shown in FIG. 6, a drag assembly 9 is attached to the metal canister 8 to reduce the speed of the falling canister without causing excessive drifting. The drag assembly 9 is made from ribbons or streamers, preferably of a nylon tape or similar material that has enough tensile strength to prevent drag assembly 9 from pulling apart during deployment and descent. Referring to FIGS. 5A, 5B, drag assembly 9 is configured with four streamers 92 as shown in FIG. 5A. The length, width and the arrangement of the streamers were optimized experimentally to provide suitable drag force, which effectively reduce the force of canister impact. The generated drag is related to the surface area of the streamers, which includes the length and the width of the streamers and is also related to the configuration of the streamers. The length, width and configuration of the streamers will change depending on the weight and dimensions of the canister.

The streamers 92 are bound together near one end with a nylon thread running stitch 94. Two brass grommets 96 are attached between the seam 94 and the end of drag assembly 9. The use of two grommets was determined experimentally to reduce the tearing action in the grommet area. Grommets 96 are attached to canister 8 with a spring pin 98 and drag assembly 9 is folded in the bottom section of the payload compartment of shell 104 just beneath canister 8. A felt disk 10 is placed immediately below drag assembly 9 to provide a cushioned spacer. The felt disk 10 rests on an expulsion plate 11. The drag generated from the drag assembly 9, as configured, was shown in field tests to reduce the falling terminal velocity of canister 8 from 82 m/sec to an acceptable 27 m/sec.

Use of a drag assembly in accordance with embodiments of the present invention will control the speed of descent of the falling canister, reduce damage to the canister on impact with the ground and at the same time minimize canister drift so that smoke obscuration is more successfully delivered in the target area.

CONCLUSION

It will be clear to one skilled in the art that the above embodiments may be altered in many ways without departing from the scope of the invention. Accordingly, the scope of the invention should be determined by the following claims and their legal equivalents.

What is claimed is:

1. A mortar cartridge assembly, comprising:

a two part shell body having a payload compartment;

a tailfin assembly positioned below said two part shell body;

at least one external propellant charge positioned above said tailfin assembly;

an ignition cartridge for igniting said propellant charge;

a fuze positioned within said shell body;

means for opening said two-part shell body while said mortar cartridge is airborne;

a canister for containing and protecting a smoke producing composition and dimensioned to be releasably secured within said payload compartment such that when said two part shell opens said canister is released, wherein said canister comprises a cylinder having a top and a bottom and includes a reinforcing plate affixed to the bottom of said cylinder, and wherein said smoke producing composition comprises an organic smoke producing agent, an oxidizer, a fuel, and a binder;

means for igniting said smoke producing composition in said smoke producing canister upon opening of said two-part shell body; and a drag assembly attached to said canister, said drag assembly comprising one or more ribbon streamers adapted to slow the descent of said canister and reduce drifting.

2. The mortar cartridge assembly of claim 1, wherein the drag assembly is adapted to generate a drag force for slowing down the canister from approximately 82 meters/sec to about 27 meters/sec.

3. The mortar cartridge assembly of claim 1, wherein the streamer is comprised of a plurality of nylon ribbons.

4. The mortar cartridge assembly of claim 1, wherein the streamer further comprises at least one grommet.

5. The mortar cartridge assembly of claim 1, wherein the streamer further comprises a spring pin for attachment to the canister.

6. The mortar cartridge assembly of claim 1, wherein said organic smoke producing agent comprises an aliphatic or aromatic dicarboxylic acid.

7. The mortar cartridge assembly of claim 1, wherein said binder comprises an organic compound.

8. The mortar cartridge assembly of claim 7, wherein said binder comprises a polyvinyl alcohol.

9. The mortar cartridge assembly of claim 7, wherein said binder comprises a polymerized sucrose.

10. The mortar cartridge assembly of claim 1, wherein said smoke producing composition comprises a Terephthalic acid (TA) based smoke producing agent.

11. The mortar cartridge assembly of claim 1, wherein said smoke producing composition comprises a mixture of 53 to 57 weight percent Terephthalic acid, 3 to 6 weight percent Magnesium Carbonate, 23 weight percent Potassium Chlorate, 1 to 3 weight percent Stearic Acid, 14 weight percent Sucrose, and 1 weight percent a Polyvinyl Alcohol binder.

12. The mortar cartridge assembly of claim 1, wherein said smoke producing composition comprises a mixture of 53 to 57 weight percent Terephthalic acid, 3 to 6 weight percent Magnesium Carbonate, 23 weight percent Potassium Chlorate, 1 to 3 weight percent Stearic Acid, and 14 weight percent Sucrose, wherein 12% to 100% of the Sucrose is polymerized to become a binder.

13. The mortar cartridge assembly of claim 1, wherein said smoke producing composition comprises between 70 to 100 weight percent Terephthalic acid (TA) and 30 to 0 weight percent pentaerythritol (PE).

14. The mortar cartridge assembly of claim 13, wherein the TA and PE combined comprise 53 to 57 weight percent of the smoke producing composition, and the smoke producing composition further comprises 3 to 6 weight percent Magnesium Carbonate, 23 weight percent Potassium Chlorate, 1 to 3 weight percent Stearic Acid, 14 weight percent Sucrose, and 1 weight percent a Polyvinyl Alcohol binder.

15. The mortar cartridge assembly of claim 1, wherein said smoke producing composition comprises a mixture of 70 to 100 weight percent Terephthalic acid (TA) and 30 to 0 weight percent pentaerythritol (PE), wherein the TA and PE together comprise 53 to 57 weight percent of the smoke producing composition, and wherein the smoke producing composition further comprises 3 to 6 weight percent Magnesium Carbonate, 23 weight percent Potassium Chlorate, 1 to 3 weight percent Stearic Acid, and 14 weight percent Sucrose, wherein 12% to 100% of the Sucrose is polymerized to become a binder.

16. The mortar cartridge assembly of claim 1, wherein said smoke producing composition comprises a yellow smoke generating composition, which comprises a mixture of 40.2 to 43.2 weight percent Dye, Solvent Yellow 33, 20.5 to 24.5 weight percent Potassium Chlorate, 17.5 to 23.5 weight percent Magnesium Carbonate, 13.8-16.8 weight percent Sucrose, and not more than 2 weight percent a Polyvinyl Alcohol binder.

17. The mortar cartridge assembly of claim 1, wherein said smoke producing composition comprises a yellow smoke generating composition which comprises a mixture of 40.2 to 43.2 weight percent Dye, Solvent Yellow 33, 20.5 to 24.5 weight percent Potassium Chlorate, 17.5 to 23.5 weight percent Magnesium Carbonate, and 13.8-16.8 weight percent Sucrose, wherein 12% to 100% of the Sucrose is polymerized to become a binder.

18. The mortar cartridge assembly of claim 1, wherein said smoke producing composition comprises a green smoke generating composition which comprises a mixture of 12 to 13 weight percent Dye, Solvent Yellow 33, 28.5 to 30.5 weight percent Dye, Solvent Green 3, 23 to 26 weight percent Potassium Chlorate, 15 to 19 weight percent Magnesium Carbonate, 15.5-17.5 weight percent Sucrose, and not more than 2 weight percent a Polyvinyl Alcohol binder.

19. The mortar cartridge assembly of claim 1, wherein said smoke producing composition comprises a green smoke generating composition which comprises a mixture of 12 to 13 weight percent Dye, Solvent Yellow 33, 28.5 to 30.5 weight percent Dye, Solvent Green 3, 23 to 26 weight percent Potassium Chlorate, 15 to 19 weight percent Magnesium Carbonate, and 15.5-17.5 weight percent Sucrose, wherein 12% to 100% of the Sucrose is polymerized to become a binder.

20. The mortar cartridge assembly of claim 1, wherein said cartridge size is 120 mm.

21. The mortar cartridge assembly of claim 1, wherein said smoke producing composition is formed into at least one consolidated element dimensioned to fit within the metal canister and comprising a longitudinal channel adapted to allow for smoke ventilation and to improve ignition reliability.

22. The mortar cartridge assembly of claim 21, wherein said at least one consolidated element is in the shape of an annulus.

23. The mortar cartridge assembly of claim 1, wherein said canister further comprises a steel reinforcing plate affixed to the bottom of the cylinder; and an attachment stud affixed to a bottom surface of the steel reinforcing plate for attaching said drag assembly.

* * * * *